US009204496B2

(12) United States Patent
Hanada et al.

(10) Patent No.: US 9,204,496 B2
(45) Date of Patent: Dec. 1, 2015

(54) PLANAR HEATING ELEMENT AND MANUFACTURING METHOD FOR SAME

(75) Inventors: Masaki Hanada, Shiga (JP); Yukio Abe, Shiga (JP); Koji Yoshimoto, Shiga (JP); Takahito Ishii, Kyoto (JP); Kazuyuki Kohara, Shiga (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 80 days.

(21) Appl. No.: 13/883,940

(22) PCT Filed: Nov. 8, 2011

(86) PCT No.: PCT/JP2011/006235
§ 371 (c)(1),
(2), (4) Date: May 7, 2013

(87) PCT Pub. No.: WO2012/063473
PCT Pub. Date: May 18, 2012

(65) Prior Publication Data

US 2013/0220994 A1 Aug. 29, 2013

(30) Foreign Application Priority Data

Nov. 8, 2010 (JP) ..... 2010-249283
Apr. 20, 2011 (JP) ..... 2011-093747

(51) Int. Cl.
*H05B 3/10* (2006.01)
*H05B 3/20* (2006.01)
*H05B 3/84* (2006.01)
*H05B 3/28* (2006.01)

(52) U.S. Cl.
CPC .. *H05B 3/20* (2013.01); *H05B 3/28* (2013.01); *H05B 3/845* (2013.01); *H05B 2203/011* (2013.01); *H05B 2203/017* (2013.01); *Y10T 156/1002* (2015.01)

(58) Field of Classification Search
USPC ..... 219/552–3, 538, 541–544; 156/196
See application file for complete search history.

(56) References Cited

FOREIGN PATENT DOCUMENTS

| | | | |
|---|---|---|---|
| CN | 1228238 | A | 9/1999 |
| EP | 2 247 157 | A1 | 11/2010 |
| JP | 03-084888 | A | 4/1991 |
| JP | 5-89952 | * | 4/1993 |

(Continued)

OTHER PUBLICATIONS

International Preliminary Report on Patentability and Written Opinion of the International Searching Authority in corresponding International Application No. PCT/JP2011/006235, and English translation thereof, dated May 23, 2013, 15 pages.

(Continued)

*Primary Examiner* — Shawntina Fuqua
(74) *Attorney, Agent, or Firm* — Brinks Gilson & Lione

(57) ABSTRACT

A planar heating element has an electrical insulating substrate, at least one pair of electrodes that includes thin metal wires covered with conductive cover layers and that is placed on a surface of the electrical insulating substrate, a polymer resistor that is placed on the electrical insulating substrate and that is supplied with electricity from the electrodes, and electrical insulating cover material 16 that covers the electrodes and the polymer resistor and that is made to adhere to the electrical insulating substrate by hot melt, and sectional shape of the conductive cover layers is of an ellipse in general with long axis parallel to the surface of the electrical insulating substrate.

9 Claims, 5 Drawing Sheets

(56) References Cited

FOREIGN PATENT DOCUMENTS

| | | | | |
|---|---|---|---|---|
| JP | 05-089952 | A | | 4/1993 |
| JP | 08-111282 | A | | 4/1996 |
| JP | 09-190841 | A | | 7/1997 |
| JP | 10-208851 | A | | 8/1998 |
| JP | 10-241841 | | * | 9/1998 |
| JP | 10-241841 | A | | 9/1998 |
| JP | 11-8102 | A | | 1/1999 |
| JP | 11-097160 | A | | 4/1999 |
| JP | 2001-110552 | | * | 4/2001 |
| JP | 2001-110552 | A | | 4/2001 |
| JP | 2010-020989 | A | | 1/2010 |

OTHER PUBLICATIONS

International Search Report for International Application No. PCT/JP2011/006235, dated Feb. 14, 2012, 2 pages.

Office Action and Search Report, and partial English translation thereof, in corresponding Chinese Application No. 201180053883.7, dated Nov. 13, 2014, 11 pages.

Extended European Search Report in corresponding European Application No. 11840698.2, dated Jul. 24, 2015, 7 pages.

* cited by examiner

PLANAR HEATING ELEMENT AND MANUFACTURING METHOD FOR SAME

This application is a 371 application of PCT/JP2011/006235 having an international filing date of Nov. 8, 2011, which claims priority to JP2010-249283 filed Nov. 8, 2010 and JP2011-093747 filed Apr. 20, 2011, the entire contents of which are incorporated herein by reference.

TECHNICAL FIELD

The present invention relates to a planar heating element for which Joule heat of a polymer resistor is utilized and which is shaped like a thin flat plate.

BACKGROUND ART

As heating parts of planar heating elements, conventionally, parts obtained by dispersion of conductive material such as carbon black, metal powder, and graphite over resin have been known. Among those, devices using PTC (abbreviation for an English term "Positive Temperature Coefficient" that signifies positive resistance temperature characteristic) heating elements that exert a self-temperature-control function through agency of combination of conductive material and resin have been known as devices having merits such as needlessness of temperature control circuit and reduction in number of components.

In these configurations, as shown in FIG. 5, covered wire members 1 in each of which a cylindrical conductive cover 2 is applied onto an electrode wire 3 for supplying electricity to a heating resistor sheet 4 are provided, and the covered wire members 1 and the heating resistor sheet 4 are welded together by heat. The covered wire members 1 and the heating resistor sheet 4 are both formed of thermoplastic resin and conductive particles such as carbon (see Patent Document 1, for instance).

It is recommended that the covered wire members 1 should be made from the same material as that of the heating resistor sheet 4 and should each have a smooth bonding surface so that the heat welding with the heating resistor sheet 4 may be made firm.

In a planar heating element, a flat plate made of aluminum or the like is commonly applied on at least one face thereof for equalization of heat, and smoothing and thinning of the planar heating element are achieved by adoption of such a configuration as described above.

Planar heating elements of this type can be formed with small thicknesses with utilization of a characteristic thereof of needlessness of temperature control circuit and thus have been used in sites each having a comparatively thin space for installation, e.g., in floor heating systems, automobile door mirrors and mirrors of washing stands, for removal of dew and frost, and the like.

Patent Document 1: JP H03-84888 A

SUMMARY OF THE INVENTION

Technical Problem

For above conventional configuration, however, optimal method of bonding to electrical insulating substrates commonly attached to top and bottom thereof for insulation has hardly been described. As a problem in applying of the substrates, it is demanded in performance and in appearance that the substrates should be applied without enclosing air voids throughout bonding parts. There has been a problem in that presence of the air voids may lead to change in quality of a polymer resistor, peeling of electrical insulating cover material and/or the like in use for long term.

In view of the problem of the conventional technology, an object of the invention is to provide a planar heating element that attains low cost and safety and that facilitates applying of substrates and a manufacturing method for the same.

Solution to Problem

In order to achieve the object, the invention is configured as follows.

A planar heating element of the invention has a sheet-like electrical insulating substrate, a sheet-like polymer resistor that is placed on the electrical insulating substrate, at least one pair of electrodes that includes thin metal wires covered with conductive cover layers, that is placed along a sheet-like surface of the polymer resistor, and that supplies electricity to the polymer resistor, and sheet-like electrical insulating cover material that is placed so as to face the electrical insulating substrate with the electrodes and the polymer resistor between and that is bonded to the electrical insulating substrate through hot melt so as to cover the electrodes and the polymer resistor, and sectional shape of the cover layers in the electrodes is of an ellipse in general with major axis extending in a direction along the sheet-like surface of the electrical insulating substrate.

Effects of Invention

In the invention, the planar heating element that is thin as a whole including electrode parts can be provided and a configuration of the electrodes of the planar heating element that attains low cost and safety and that facilitates applying of the substrate can be provided.

BRIEF DESCRIPTION OF THE DRAWINGS

These aspects and features of the present invention will become clear from the following description taken in conjunction with the preferred embodiments thereof with reference to the accompanying drawings, in which.

DETAILED DESCRIPTION OF THE PREFERRED EMBODIMENTS

Figure 1:
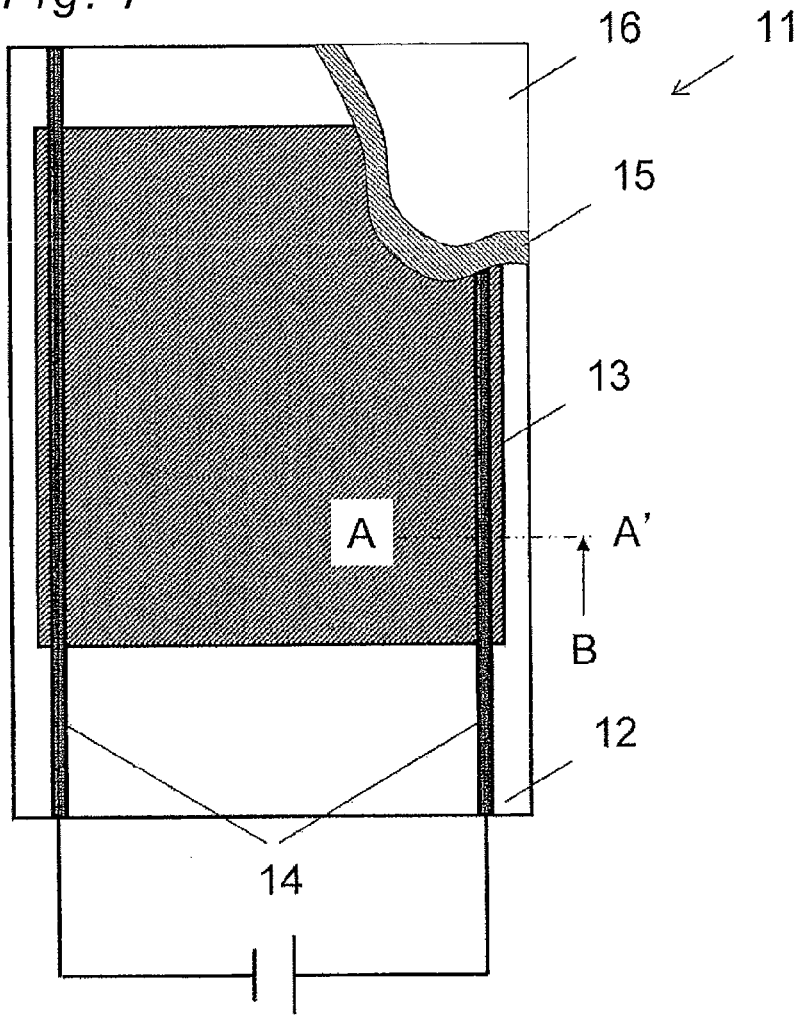
FIG. 1 is a plan view showing a configuration of a planar heating element in embodiment 1.

A first invention is directed to a planar heating element comprising a sheet-like electrical insulating substrate, a sheet-like polymer resistor placed on the electrical insulating substrate, at least one pair of electrodes that includes thin metal wires covered with conductive cover layers, that is placed along a sheet-like surface of the polymer resistor, and that supplies electricity to the polymer resistor, and sheet-like insulating cover material that is bonded to the electrical insulating substrate through hot melt so as to cover the electrodes and the polymer resistor, the insulating cover material facing to the electrical insulating substrate, the electrodes and the polymer resistor being placed between the insulating cover material and the electrical insulating substrate, wherein sectional shape of the cover layers in the electrodes is of an ellipse in general with major axis extending in a direction along a sheet-like surface of the electrical insulating substrate.

The sectional shape of the conductive cover layers is of such an ellipse in general as described above, and thus followability between the electrodes and the polymer resistor is improved. The generally elliptical section of the cover layers makes the hot melt prone to flow to fill differences in level between the cover layers and the sheet-like polymer resistor and provides resistance to enclosure of air voids in vicinity of contact parts between the cover layers and the polymer resistor which parts are more prone to include air voids than other parts. Decrease in presence of the air voids is not only preferable in terms of appearance but also preferable in terms of safety and quality because the polymer resistor thereby resists being deteriorated with long-term use and because the electrical insulating cover material thereby resists peeling.

A second invention is directed to the planar heating element according to the first invention, wherein a sheet-like outer surface of either one of the electrical insulating cover material and the electrical insulating substrate is generally flat in a region where the electrodes are placed.

The flat (planar) shape of the one surface improves installability of the planar heating element that is often installed in a comparatively narrow site and improves industrial utility thereof A flat plate made of aluminum or the like is commonly applied on at least one face thereof in order to improve heat radiation ability of the planar heating element, and provision of the planar shape to the one face facilitates joining thereof onto the plate made of aluminum or the like.

A third invention is that softening point of the conductive cover layers is a temperature equal to or lower than sum of melting point of the hot melt and 100° C. In a step of applying an electrical insulating substrate and electrical insulating cover material, in general, temperature of hot melt that is adhesive means is increased to melting point thereof or higher. The softening point of the conductive cover layers is the temperature equal to or lower than the sum of the melting point of the hot melt and 100° C., and thus the conductive cover layers are simultaneously increased in temperature and softened, so that the conductive cover layers can easily be deformed. That is, the conductive cover layers are deformed into a generally elliptical shape by pressures from the electrical insulating substrate and the electrical insulating cover material in the applying step, irrespective of sectional shape of the conductive cover layers prior to the applying step, and thus effects of the first invention can be obtained.

A fourth invention is that sectional area of the cover layer is equal to or larger than double of sectional area of the thin metal wires in a section of each electrode along a longitudinal direction. By setting of the sectional area of the conductive cover layers that is sufficiently larger than the sectional area of the thin metal wires, the deformation of the conductive cover layers is further facilitated, and thus not only are the air voids further lessened in the applying between the electrical insulating substrate and the electrical insulating cover material, but also the planar heating element can be thinned. When the thin metal wires are heated and pressurized in the applying step, deformation of the thin metal wires is smaller than that of the conductive cover layers and the sectional area thereof is not decreased.

A fifth invention is that at least three or more electrodes in which adjoining electrodes have different polarities and which are disposed generally in parallel to one another are provided as at least the one pair of electrodes, and the electrodes are placed on the sheet-like polymer resistor so that length between at least one pair of electrodes differs from length between the other pairs of electrodes.

Thus any desired sites in the planar heating element can more intensively be heated and sites in an object to be heated that resist being increased in temperature can efficiently be heated, so that unevenness in temperature in the object to be heated can be decreased. This can be achieved in a highly simple manner because output distribution in the planar heating element can be obtained only by adjustment of intervals between the electrodes without adjustment of materials of the resistor. For an object to be heated, such as battery, which requires high reliability and for which excessive increase in temperature thereof is undesirable, in particular, the planar heating element of the invention provides high output for specified sites that resist being increased in temperature, thus has an extremely low risk of undergoing the excessive increase in the temperature, and has a safe and highly reliable configuration. As compared with a planar heating element that has a resistor of the same material and the same area and that has uniform intervals between electrodes, additionally, total inrush output power can be increased, rate of rise in increase in the temperature can further be sharpened, and a space for the planar heating element can be saved.

A sixth invention is directed to the planar heating element according to the fifth invention, wherein length between one pair of electrodes placed in an end part of the planar heating element is smaller than length between another pair of electrodes placed in next place.

Thus increase in output in sites in the planar heating element that are prone to radiate heat and decrease in unevenness in temperature in the planar heating element can be attained and heat conduction can be facilitated in order to more intensively heat the sites that are prone to radiate heat, in addition to functions and effects of the fifth invention.

A seventh invention is that length between one pair of electrodes on one side out of pairs of electrodes placed in both end parts of the planar heating element is smaller than length between the other pair of electrodes.

On condition that an object to be heated is large in size along a direction perpendicular to direction in which the electrodes extend and that two or more planar heating elements are used, in this manner, the planar heating elements can be placed so that an end part of each planar heating element on one side coincides with an end part of the object to be heated that is more prone to radiate heat than other sites, and amount of generated heat can be increased in the end parts on the one side with limitation thereto. In opposite end parts of the planar heating elements, which end parts do not coincide with the end parts of the object to be heated, it is unnecessary to make the length between the electrodes therein smaller.

An eighth invention is that the polymer resistor has PTC property, and wherein second derivatives of resistance value of the polymer resistor with respect to temperature thereof are always positive at least in a region of 0° C. to 80° C.

In addition to the functions and effects of the first and fifth inventions, in this manner, not only total output on occasion of inrush when application of voltages is started but also total output on occasion when the temperature is stable can be increased as compared with a planar heating element that has a resistor of the same material and the same area and that has uniform intervals between electrodes.

A ninth invention is directed to a manufacturing method for a planar heating element, the method comprising: placing a sheet-like polymer resistor and at least one pair of electrodes that includes thin metal wires covered with conductive cover layers, that is placed along a sheet-like surface of the polymer resistor, and that supplies electricity to the polymer resistor, with hot melt interposed, between a sheet-like electrical insulating substrate and sheet-like electrical insulating cover material, softening the cover layers and changing sectional shape thereof into an elliptical shape in general with major axis extending in a direction along a sheet-like surface of the electrical insulating substrate by pressurizing with heating, and bonding the electrical insulating substrate and the electrical insulating cover material with the polymer resistor and the electrodes between by melting the hot melt. That is, the heating and pressurizing processes are adopted as a method of bonding and processing the electrical insulating substrate and the electrical insulating cover material. In addition to attainment of the effects of the first invention, simultaneous performance of the heating and the pressurizing in the bonding makes it possible to stably cause gas such as air to escape from applied surfaces and to cause the hot melt to flow into vicinity of the electrodes, so that the enclosure of air voids can further be avoided.

Among methods of simultaneously performing the heating and the pressurizing are laminating in which upper and lower surfaces of a planar heating element are pressurized by heating rubber rollers, press working in which upper and lower surfaces of a planar heating element are pressed by heated flat plates, and the like, for instance.

Hereinbelow, embodiments of the invention will be described with reference to the accompanying drawings. The invention, however, is not limited to the embodiments.

(Embodiment 1)

Figure 2:
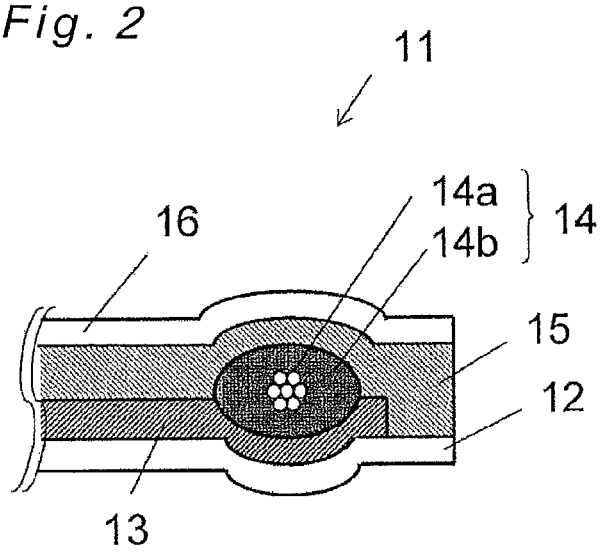
FIG. 2 is a sectional view taken along line A-A' of FIG. 1, as seen looking in a direction of an arrow B.

FIG. 1 is a diagram showing a schematic configuration of a planar heating element 11 in embodiment 1 of the invention, and FIG. 2 is a sectional view taken along line A-A' shown in FIG. 1, as seen looking in a direction of an arrow B.

The planar heating element 11 is formed by placement of a pair of electrodes 14 on both sides of a polymer resistor 13 placed on an electrical insulating substrate 12 made of polyethylene terephthalate or the like, and electrical insulating cover material 16 that is coated with hot melt 15 in advance and that is made of polyethylene terephthalate or the like is applied by heat welding on the electrical insulating substrate 12, the polymer resistor 13, and the electrodes 14. Depiction of lead wires for supplying electricity to the electrodes 14 is omitted.

The electrodes 14 are each formed of stranded thin metal wires 14*a* and a conductive cover layer 14*b* covering the thin metal wires 14*a*. Used as the thin metal wires 14*a* are fifteen pieces of silver-copper alloy wire that each have a diameter of 0.06 mm and that are twisted together, for instance. In FIG. 2, only seven pieces of wire are shown for sake of simplicity.

Subsequently, materials of and manufacturing methods for components of the planar heating element will be described.

For the conductive cover layers 14*b*, kneaded material was produced from 21% by weight ethylene/vinyl acetate copolymer (brand name "Evaflex EV150" produced by DuPont-Mitsui Polychemicals Co., Ltd., softening point of about 50° C., melting point of about 80° C.) as resin component, 9% by weight resin containing maleic anhydride (brand name "Bondine LX4110" (ethylene/acrylic ester/maleic anhydride terpolymer resin) produced by Sumitomo Chemical Co., Ltd., which softens in vicinity of 100° C.) as a functional group showing metal affinity, 45% by weight conductive whisker (brand name "FTL-110", needle-like titanium oxide, produced by Ishihara Sangyo Kaisha, Ltd.) as conductive material, 15% by weight carbon black (brand name "Printex L", primary particle size of 21 nm, produced by Degussa AG), and 10% by weight flame retardant (brand name "Reophos RDP", phosphate ester-based liquid flame retardant, produced by Ajinomoto Co., Inc.), and the generally round electrodes 14 that cover the kneaded thin metal wires 14*a* and that have a diameter of 800 μm were thereafter obtained. Sectional area of each conductive cover layer 14*b* as seen looking in direction of flow of current is supposed to be equal to or larger than double of sectional area of the stranded thin metal wires 14*a*. Resin component of the functional group showing the metal affinity in the conductive cover layers 14*b* has low softening point, and the conductive cover layers 14*b* as complexes therefore have a softening point of about 100° C.

Co-extrusion molding that is used as a method of processing common lead wires or the like is employed as a processing method for the covering, and thus stable processing with low costs can be attained. The comparatively low softening point of the conductive cover layers 14*b* results in satisfactory extrudability, and the generally round shape thereof facilitates winding thereof.

Specific electrical resistance between outer peripheral part of the cover and center metal part was 5Ω·cm, and flame retardancy thereof satisfied FMVSS302.

By use of material having PTC property for the polymer resistor 13, self-temperature-adjustment function is provided such that increase in temperature causes increase in resistance value of the polymer resistor 13, which results in attainment of a specified temperature, and thus a function as the planar heating element that does not require temperature control and that is highly safe is provided. In the manufacturing method for the polymer resistor 13, after the kneading of the materials, thickness thereof is reduced by about 100 to 200 μm by calendering, and cutting to generally rectangular shapes is performed by Thomson processing.

Material containing crystalline polyester resin, having melting point of about 110° C., as principal ingredient was used as the hot melt 15. On one surface of the insulating cover material 16, the hot melt 15 has been applied and formed in advance by T-die extrusion. Though an example in which the softening point of the conductive cover layers 14*b* is about 100° C. is used in the embodiment 1, a temperature equal to or lower than temperature that is 100° C. higher than the melting point of the hot melt 15 (that is, temperature equal to or lower than sum of the melting point and 100° C.) may be employed as the softening point of the conductive cover layers 14*b*.

Polyethylene terephthalate substrates having thickness of 50 μm were used for the electrical insulating substrate 12 and the electrical insulating cover material 16.

Subsequently, a step of assembling members described above will be described.

Figure 3:
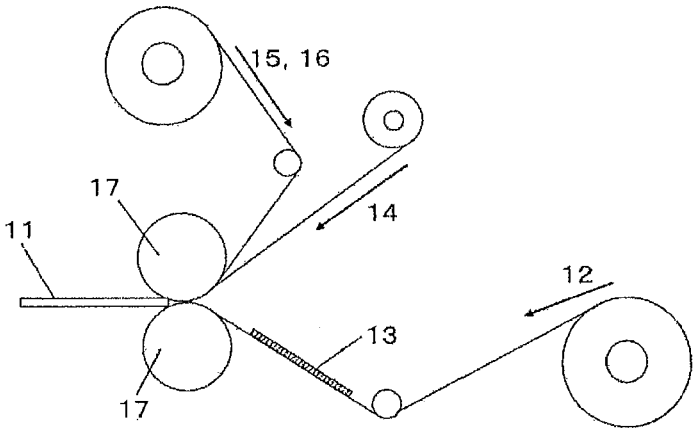
FIG. 3 is a schematic representation of a laminating system in the embodiment 1 of the invention.

FIG. 3 shows a schematic side view of a laminating system. In the system, the electrical insulating substrate 12, the polymer resistor 13, the electrodes 14, and the electrical insulating substrate 16 can simultaneously be applied together. The system comprises feeder rolls for the electrical insulating substrate 12, the polymer resistor 13 and the electrodes 14, and heating rollers 17 for performing the heating and the pressurizing for the applying on the upper and lower surfaces.

As for temperature setting for the heating rollers 17, the temperature equal to or higher than 110° C. that is the melting point of the hot melt 15 makes it possible to attain the applying, but the temperature is preferably set to be at least 50 to 100° C. higher than the melting point of the hot melt 15, because insufficient melted state of the hot melt may result in the bonding with strain remaining in the polymer resistor 13 in the applying. On the other hand, increase to a temperature in vicinity of 190° C. that causes great changes in sizes of the electrical insulating substrate 12 and the electrical insulating substrate 16 is not preferable. Accordingly, the temperature of the heating rollers 17 was set at 170° C. in the embodiment 1.

The conductive cover layers 14*b* are fed and supplied in a generally circular shape in section, whereas the sectional shape is subsequently crushed and becomes elliptical so as to have major axis along a direction in which the electrical insulating substrate 12 extends, because the conductive cover layers 14*b* are softened by being heated to vicinity of the softening point and are further subjected to pressures from the upper and lower sides when passing through between the heating rollers 17. In the embodiment, ratio in length of minor axis to major axis of the ellipse of the conductive cover layers 14*b* was on the order of 1:2.

After the applying is performed by the heating rollers 17, lead wires and/or the like are connected to the stranded thin metal wires 14*a*, so that the planar heating element 11 is finished.

Subsequently, effects of the embodiment 1 of the invention will be described.

In processing step described above, the melting point of the hot melt 15 is about 110° C., the softening point of the conductive cover layers 14*b* is about 100° C., and the setting temperature of the heating rollers 17 is about 170° C. The heating rollers 17 heat the conductive cover layers 14*b* to the temperature equal to or higher than the softening point while increasing the temperature of the hot melt 15 to the temperature equal to or higher than the melting point, and thus the applying between the electrical insulating substrate 12 and the electrical insulating cover material 16 through the hot melt 15 and the change in the shape of the conductive cover layers 14*b* can simultaneously be performed, so that the processing step that is convenient and that requires small number of man-hours is attained. In addition, the change in the shape of the conductive cover layers 14*b* into the generally elliptical shape that follows the electrical insulating substrate 12 and the electrical insulating cover material 16 eliminates the difference in level between the conductive cover layers 14*b* and the polymer resistor 13 and prevents enclosure of air voids that might be produced by the applying in vicinity of the conductive cover layers 14*b*. In the elliptical shape of the conductive cover layers 14*b*, the ratio in length of the minor axis to the major axis thereof is preferably on the order of 1:1.5, at least, or greater than that. The crush of the conductive cover layers 14*b* and the prevention of the enclosure of the air voids lead to smoothing and thinning and ensure the planar heating element 11 having satisfactory installability.

The prevention of the enclosure of air voids in the vicinity of the conductive cover layers 14*b* provides an advantage in long-term reliability of the polymer resistor 13. The polymer resistor 13 tends to deteriorate through agency of oxidation, whereas the embodiment 1 in which insulation from air can be attained provides the planar heating element 11 that resists oxidative deterioration and that has long-term reliability. Air voids may become base points of peeling of the electrical insulating cover material 16, and thus elimination of the air voids is advantageous in terms of safety against electrical shock or the like also.

The polymer resistor 13 and the conductive cover layers 14 are covered with the hot melt 15 and the electrical insulating substrate 12 and the electrical insulating cover material 16 that are on upper and lower sides thereof, and thus cannot readily be moved. Therefore, satisfactory electrical and physical contact thereof can be maintained and little contact resistance exists between both. By such covering for the conductive cover layers 14*b* as described above, a satisfactory contact configuration with little contact resistance can be provided only by the softening and following of the conductive cover layers 14*b* without melting and welding thereof.

Such a follow effect obtained from the deformation of the conductive cover layers 14*b* can be attained because the sectional areas of the conductive cover layers 14*b* are sufficiently larger than those of the stranded thin metal wires 14*a*. It is needless to say that the sectional areas of the stranded thin metal wires 14*a* are not decreased by the heating and the pressurizing in the applying.

(Embodiment 2)

Figure 4:
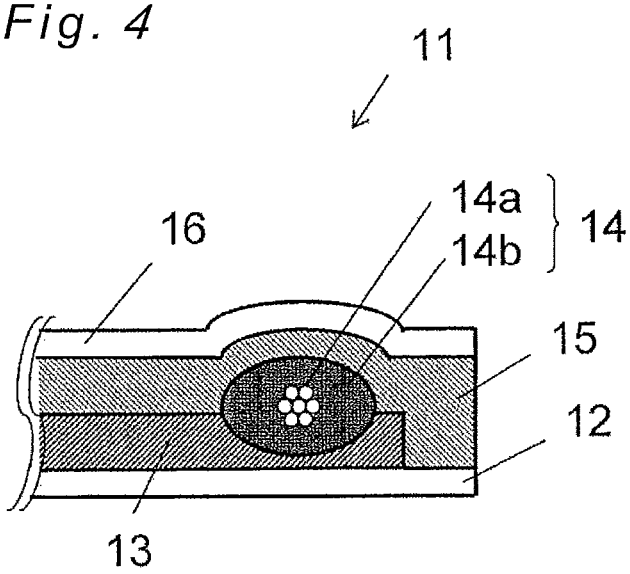
FIG. 4 is a sectional view showing a configuration of a planar heating element in embodiment 2 of the invention.
Figure 5:
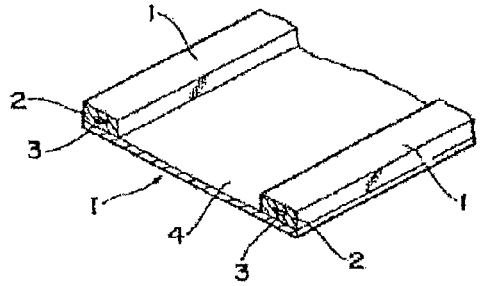
Fig. 5 Prior Art
FIG. 5 is a schematic perspective view showing a conventional heating element.

FIG. 4 is a sectional view showing a schematic configuration of the planar heating element 11 in embodiment2 of the invention. Schematic plan view thereof is omitted because the view is the same as FIG. 1 of the embodiment 1.

With reference to FIG. 4, the embodiment 2 is different from the embodiment 1 in the sectional shape of the conductive cover layers 14*b* and thickness of the electrical insulating substrate 12, and only different components will be described with the same components designated by the same reference numerals.

The thickness of the electrical insulating substrate 12 is 100 μm and is made greater than thickness of 50 μm of the electrical insulating cover material 16. When the electrical insulating substrate 12 and the electrical insulating cover material 16 are applied together through the hot melt 15 in the same processing method (FIG. 3) as that in the embodiment 1, the electrical insulating substrate 12 is hardly deformed and the electrical insulating cover material 16 is deformed so as to follow thicknesses of the conductive cover layers 14*b* and the polymer resistor 13 because rigidity of the electrical insulating substrate 12 is greater than that of the electrical insulating cover material 16.

An even and planar surface of the electrical insulating substrate 12 brings about improvement in mountability of the planar heating element 11 on the surface of the electrical insulating substrate 12, thus improving industrial utility thereof. In the planar heating element 11, a flat plate made of aluminum or the like is commonly applied on one face thereof for equalization of heat, and provision of the planar shape to the one face facilitates joining thereof onto the heat equalizing plate made of aluminum or the like.

Such a planar heating element 11 is used in sites each having a comparatively thin space for mounting, e.g., in floor heating systems, automobile door mirrors and mirrors of washing stands, for removal of dew and frost, and the like, and thus the improvement in the mountability leads to expansion of applications.

A difference between pressures on upper and lower surfaces of the conductive cover layers 14*b* is produced by the difference in the rigidity according to the difference in thickness between the electrical insulating substrate 12 and the electrical insulating cover material 16, and the surface of the electrical insulating substrate 12 is thereby made planar in the embodiment 2, whereas the planar shape may be attained by difference in the rigidity that is made by change in the materials of the electrical insulating substrate 12 and the electrical insulating cover material 16 (e.g., polyethylene terephthalate and polybutylene terephthalate or the like), by use of different materials (e.g., metal and rubber or the like) for the upper and lower heating rollers 17 for use in the processing, by difference in tension for the feeding of the electrical insulating substrate 12 and the electrical insulating cover material 16, or the like, as a matter of course. It is needless to say that the surface which is made planar may be on either the electrical insulating substrate 12 or the electrical insulating substrate 16.

Though molded sections of the conductive cover layers 14*b* are generally circular in the embodiments 1 and 2, the effects of the invention can be obtained even with use of any shape such as quadrangular and generally elliptical shape because the shape is deformed by the heating rollers 17.

Though the heating rollers 17 are used for the processing method for applying the electrical insulating substrate 12 and the electrical insulating cover material 16 together in the embodiments 1 and 2, the effects of the invention can be obtained with use of any means as long as the means is capable of performing the heating and pressurizing, e.g., by hot pressing.

(Embodiment 3)

Subsequently, a planar heating element that is chiefly used in such applications as are for heating a battery in an automobile or the like, an electrical floor heating panel or the like in cold districts, for instance, will be described as an example of a planar heating element in accordance with embodiment 3 of the invention.

Figure 10:
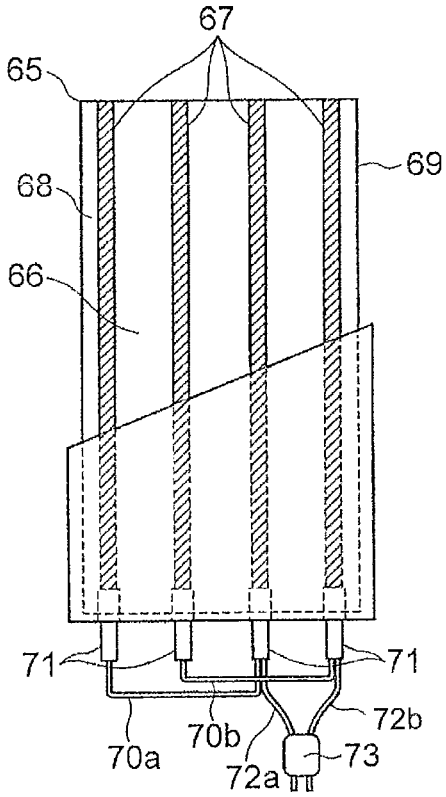
Fig. 10 Prior Art
FIG. 10 is a plan view of a conventional planar heating element.

In a planar heating element 65 of this type, conventionally, as shown in FIG. 10, a planar heating part 69 is formed by impregnation in carbon-based conductive paint 66 of a woven fabric 68 in which a plurality of copper wire groups 67 for electrodes are arranged at specified intervals between warp threads and drying of the paint, an electrode terminal 71 is fixed to an end of each copper wire group 67 for electrode, and the planar heating part 69 is thereafter covered with electrical insulating resin. Then each pair of electrode terminals 71 on every other position out of the electrode terminals is mutually connected by a lead wire 70*a*, 70*b*, and a lead wire 72*a*, 72*b* derived from one terminal of each lead wire 70*a*, 70*b* is connected to a plug socket 73. [0061] For a battery installed in an automobile, as an example of a field of application of the planar heating element of this type, an environment in which temperature can fall to −30° C. or below may cause freezing of battery fluid or may cause notable decrease in capacity of the battery, even if the battery fluid does not freeze, and may increase a risk of failure to start an engine, and therefore means for heating the battery itself by an auxiliary heat source and thereby preventing decrease in the capacity of the battery has been devised.

Figure 11:
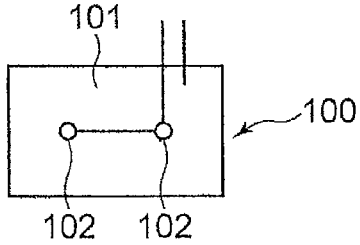
Fig. 11 Prior Art
FIG. 11 is a side view of a conventional planar heating element.
Figure 12:
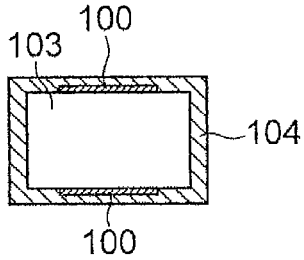
Fig. 12 Prior Art
FIG. 12 is a sectional view of major parts of the conventional planar heating elements.

As shown in FIGS. 11 and 12, conventional planar heating elements 100 of this type each include a radiator plate 101 onto which ceramic PTC heating elements 102 are attached, and are placed around a battery 103. Heat insulator 104 is placed on outer periphery of the battery 103 so as to cover the planar heating elements 100, and the battery 103 is heated with use of the battery 103 as a power supply (see JP H09-190841 A, for instance).

For addressing energy saving and $CO_2$ reduction, in recent years, hybrid vehicles having combination of engine and motor, electric vehicles using only motor as power source, and the like have been drawing increasing attention. For batteries installed in those vehicles, increase in the capacity is required for drive of the motor, and the batteries with increased voltages and great capacities are provided by housing of a battery module having several cells connected in series as one unit in a case and by connection of a large number of battery units in series (furthermore in parallel, as required), as to form of the batteries.

In these batteries also, the decrease in the capacity under a severe low temperature environment is problematic as in conventional batteries, and it is conceivable to heat the batteries by such means as described in JP H09-190841 A. Such means as described in JP H11-97160 A, however, causes a problem in that uniform heating of the whole of a battery cannot be attained because shape of the battery that is an object to be heated is not a simple rectangle, though the planar heating element has uniform distribution of heat generation, and because there exist a distribution of state of heat radiation and/or a distribution of heat capacity in the battery, depending on mounted position even if the shape is rectangular, and such means as described in JP 1109-190841 A causes a problem in that uniform heating of the whole of a battery cannot be attained because distribution of heat generation therein is merely of natural heat radiation through a copper radiator plate. The term "distribution of heat generation" refers to a distribution with which an object (i.e., planar heating element) that is generating heat is to generate heat, and does not take radiation of heat into consideration.

The embodiment that will be described hereinbelow further resolves such a problem and an object of the embodiment is to provide a planar heating element that reduces uneven heating of an object to be heated with a simple configuration, that is superior in durability, and that is highly safe.

The planar heating element in accordance with the embodiment 3 of the invention will be described with reference to FIGS. 6 and 7.

Figure 6:
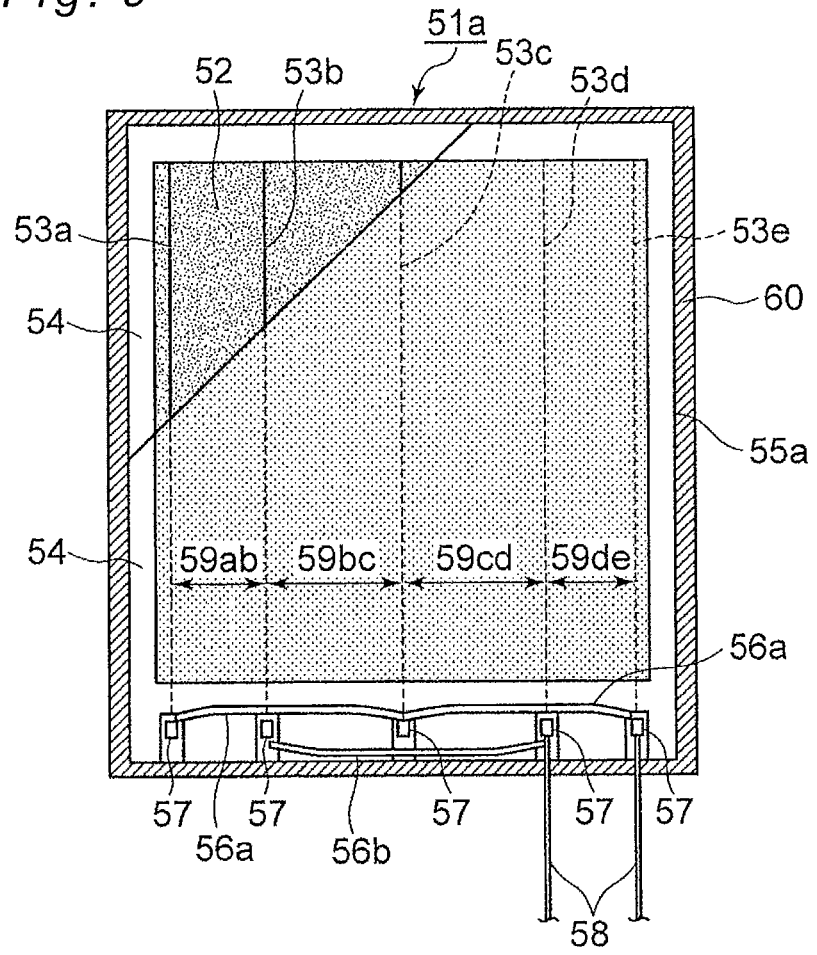
FIG. 6 is a plan view showing a configuration of a planar heating element in embodiment 3 of the invention.
Figure 7:
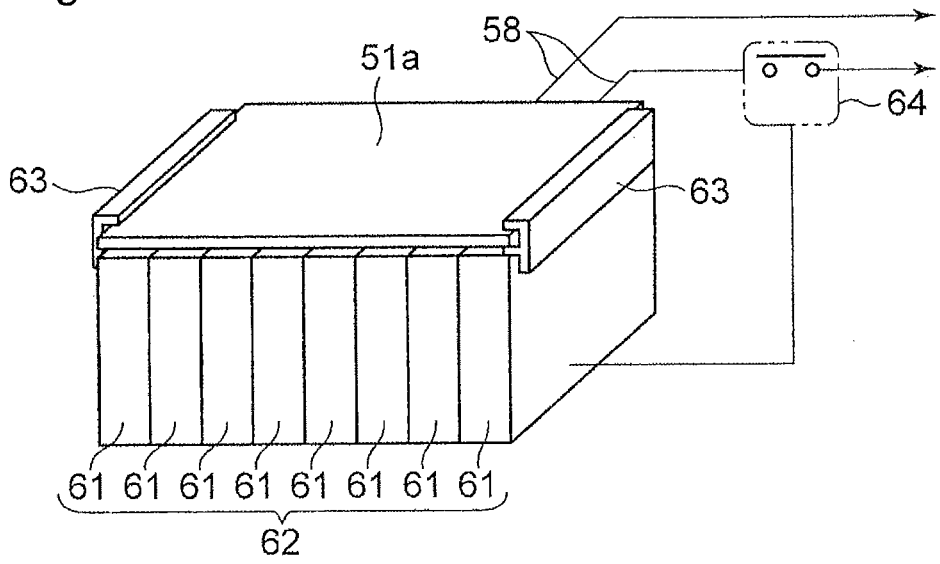
FIG. 7 is a representation of connection for cells in a battery module on which the planar heating element in the embodiment 3 of the invention is mounted.

FIG. 6 is a plan view of the planar heating element, and FIG. 7 is a representation of connection for cells in a battery module on which the planar heating element is mounted.

As shown in the plan view of the planar heating element 51*a* of FIG. 6, a resistor sheet 55*a* is formed by provision of electrode wires 53*a*, 53*b*, 53*c*, 53*d*, 53*e* formed of stranded copper wires (thin metal wires) on a polymer resistor 52 that is shaped like a film by kneading of resin and conductive carbon and that has PTC property, sandwiching of the polymer resistor 52 and the electrode wires 53*a* through 53*e* between PET films 54 that are electrical insulating substrates and that are laminated with hot melt resin, and thermal bonding of the PET films 54, the polymer resistor 52 and the electrode wires 53*a* through 53*e* by hot pressing or heat lamination. A region where the polymer resistor 52 does not exist and where only the electrode wires 53*a* through 53*e* and the PET film 54 exist is provided on one side of extension of the electrode wires in the resistor sheet 55*a*, and connection parts 57 are formed by cutout of the PET film 54 in vicinity of end parts of the electrode wires 53*a* through 53*e*, exposure of the end parts of the electrode wires 53*a* through 53*e*, and electrical and physical connection thereof to feeding lead wires 56*a*, 56*b* by soldering, spot welding or caulking using sleeve terminals. With the electrode wires 53*a*, 53*c*, 53*e* set in one polarity and the electrode wires 53*b*, 53*d* set in the other polarity, the electrode wires 53*a*, 53*c*, 53*e* are connected by the feeding lead wire 56*a* and the electrode wires 53*b*, 53*d* are connected by the feeding lead wire 56*b* so that adjoining electrode wires in the electrode wires 53*a* through 53*e* have different polarities. Numeral 58 denotes power supply wires.

In addition, a heat equalizing aluminum plate 60 is applied on one surface of the resistor sheet 55*a* by double-sided tape.

Interelectrode distance (interelectrode length) 59*ab* between the electrode wires 53*a*, 53*b* and interelectrode distance 59*de* between the electrode wires 53*d*, 53*e* are designated by X, interelectrode distance 59*bc* between the electrode wires 53*b*, 53*c* and interelectrode distance 59*cd* between the electrode wires 53*c*, 53*d* are designated by Y, and relation X<Y is established.

The polymer resistor 52 has the PTC property, that is, the characteristic in which increase in temperature causes increase in resistance value thereof and, in particular, material by which second derivatives of the resistance value of the polymer resistor 52 with respect to the temperature are made always positive in a region of 0° C. to 80° C. is used therefor.

The polymer resistor 52 is not limited to a simple film and may be in a form in which reinforcement material such as nonwoven fabric is applied thereon or in which reinforcement material such as nonwoven fabric is embedded in the film of the polymer resistor 52 in order to attain reinforcement or in a form in which reinforcement material such as nonwoven fabric is impregnated with kneaded material including resin and conductive carbon.

In place of the stranded copper wires used as the electrode wires 53*a* through 53*f*, wires coated with the same material as that of the polymer resistor 52 or material with composition approximating to that of the polymer resistor 52 may be used in order to attain firmer adherence to the polymer resistor 52 or copper single wires, copper flat wires or the like may be used, if used in sites where flexibility of the planar heating element 51 is not so required. Not only copper but also other metal wires may be used as material of the electrode wires.

The same PET films 4 are used in the embodiment 3, whereas PET films having different thicknesses may be used as required and materials of the films may be different, as long as functions thereof are maintained.

Aluminum may be replaced as material of the heat equalizing aluminum plate 60 by copper for further advance in equality of heating, or may be replaced by iron or may be omitted, more conveniently, provided that the equality of heating in the planar heating element 51 is not so required.

FIG. 7 is the representation of connection for the cells in the battery module on which the planar heating element 51*a* is mounted, a battery 62 that is an object to be heated is formed by lamination of the battery modules 61 each having a plurality of cells connected in series, and the planar heating element 51*a* facing one face of the battery 62 is supported by support members 63 through the heat equalizing aluminum plate 60 and is fixed with a gap provided between the plate 60 and the battery 62. The planar heating element 51*a* can be turned on and off by control means 64, when the temperature of the battery fulfills a condition with a predetermined temperature or is lower than the temperature or when a user intends to do so.

Hereinbelow, operations and functions of the planar heating element configured as described above will be described.

After energization of the planar heating element 51*a* and lapse of a certain period of time, increase in the resistance value caused by increase in the temperature results in decrease in wattage, because the polymer resistor 52 has the PTC property, and a stable temperature is achieved when heat generation and heat radiation thereby balance each other out. Therefore, a temperature distribution is produced by difference in amount of heat radiation in the surface of the planar heating element 51*a* as a characteristic of the planar heating element 51*a* in which temperature control is performed on basis of the PTC property. In the embodiment 3 of the invention, the planar heating element 51*a* is supported on end faces thereof by the support members 63, and the end faces of the planar heating element 51*a* are particularly prone to radiate heat and resist increase in temperature thereof. The interelectrode distance 59*ab*, 59*de* in end parts, however, is smaller than the interelectrode distance 59*bc*, 59*cd* in center part, and thus heating parts configured by the electrode wires 53*a*, 53*b* and the electrode wires 53*d*, 53*e* generate greater amount of heat than and are more prone to increase in temperature than heating parts configured by the electrode wires 53*b*, 53*c* and the electrode wires 53*c*, 53*d*. Thus the temperature distribution in the planar heating element 51*a* can be made evener, and sites that are prone to radiate heat are heated more intensively, so that heat conduction to the battery 62 is facilitated. The even temperature distribution in the planar heating element 51*a* leads to even temperature distribution in the battery 62 that is an object to be heated and reduces unevenness in output among the battery modules 61. The term "temperature distribution" refers to a distribution of temperature as a result of heat absorption and heat radiation, as to both of heating element (i.e., planar heating element) and object to be heated (i.e., battery).

Subsequently, output of the planar heating element 51*a* will be described. The planar heating element 51*a* provides high output in the heating parts that are configured by the electrode wires 53*a*, 53*b* and by the electrode wires 53*d*, 53*e* and that resist being increased in temperature. Therefore, the planar heating element has an extremely low risk of undergoing excessive increase in temperature, as a matter of course, and is highly useful for the battery 62 which requires high reliability and for which the excessive increase in temperature is undesirable. In the planar heating element 51*a*, as compared with a planar heating element that has a resistor of the same material and the same area and that has uniform intervals between electrodes, total inrush output power can be increased, rate of rise in increase in the temperature can further be sharpened, and a space for the planar heating element can be saved. Though this can easily be shown by comparison of calculation of parallel resistance on assumption that there is no temperature distribution in the planar heating element 51*a* on occasion of inrush, such description is omitted herein. The planar heating element 51*a* is used in an environment with very low temperature equal to or lower than −10° C. where the capacity of the battery 62 decreases, and the stabilizing temperature for the planar heating element 51*a* is between 0° C. and 80° C., depending on voltage, state of heat radiation, the PTC property and the like. Output of the planar heating element 51*a* upon achievement of the stabilizing temperature can be increased, as compared with a planar heating element that has a resistor of the same material and the same area and that has uniform intervals between electrodes, the rate of rise in increase in the temperature of the battery 62 can further be sharpened, and the space for the planar heating element can be saved. Though this can easily be shown by the comparison of the calculation of the parallel resistance with specification of average temperature of each heating part on condition that the second derivatives of the resistance value of the polymer resistor 52 with respect to the temperature are always positive in the region of 0° C. to 80° C., such description is omitted herein.

In the embodiment 3 of the invention, the output distribution in the planar heating element and the functions and effects described above can be obtained only by adjustment of the intervals between the electrodes without adjustment of material of the resistor, and thus the planar heating element that achieves evener temperatures and great total output at the rising and in a period of time with stabilized temperatures can be provided in a highly simple manner. The term "output distribution" refers to a distribution of output with which heat is to be generated, and does not take radiation of heat into consideration.

(Embodiment 4)

Figure 8:
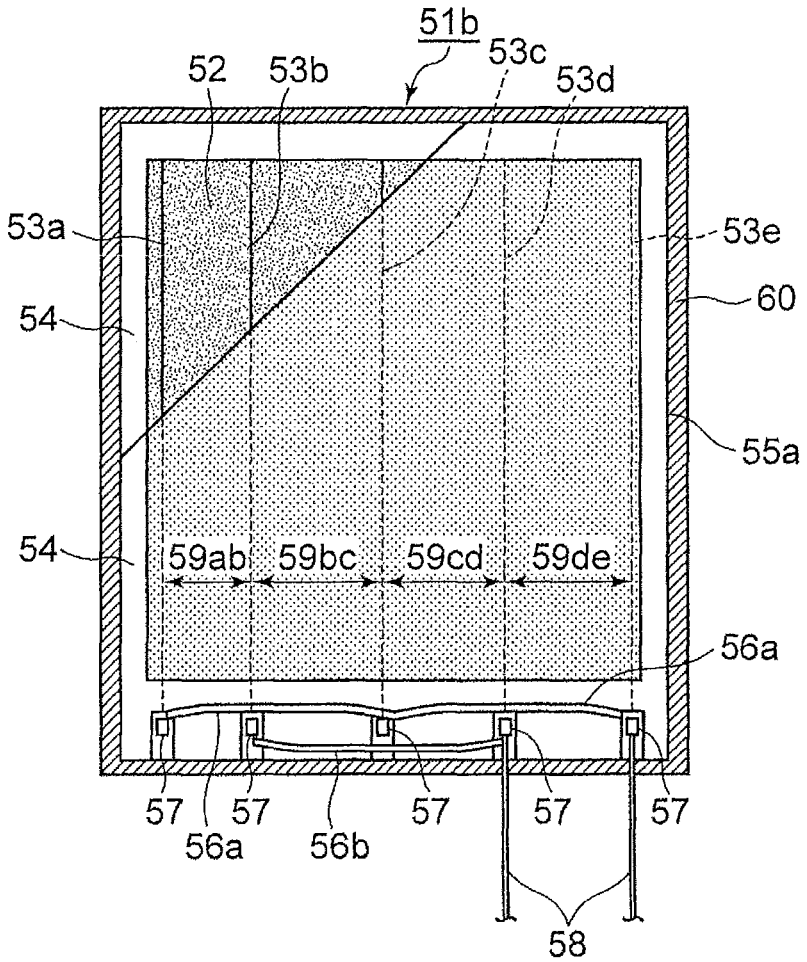
FIG. 8 is a plan view showing a configuration of a planar heating element in embodiment 4 of the invention.
Figure 9:
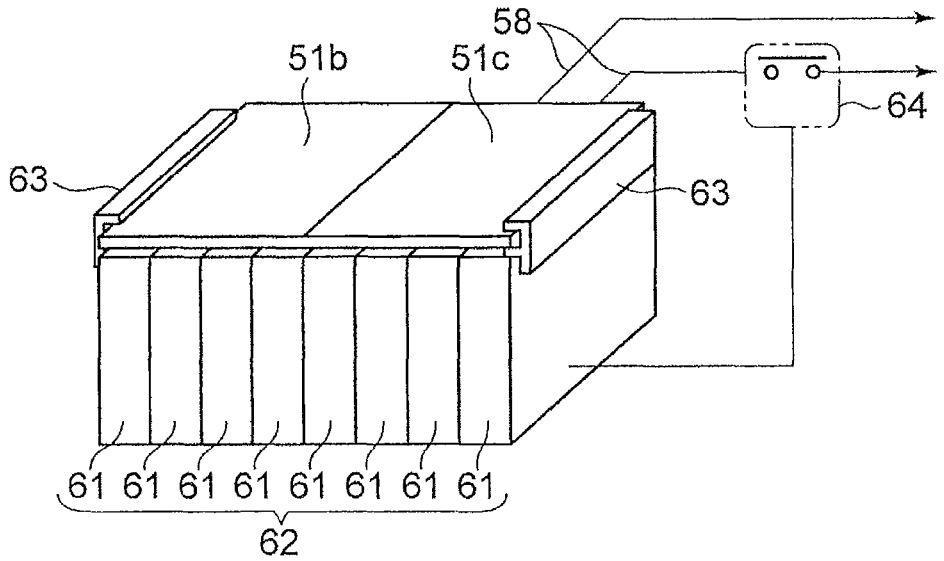
FIG. 9 is a representation of connection for cells in a battery module on which the planar heating elements in the embodiment 4 of the invention is mounted.

Planar heating elements in accordance with embodiment 4 of the invention will be described with reference to FIGS. 8 and 9. FIG. 8 is a plan view of a planar heating element, and FIG. 9 is a representation of connection for cells in a battery module on which the planar heating elements are mounted.

In the planar heating element 51*b* of FIG. 8, basic configurations of the resistor sheet composed of the electrode wires, the resistor, and the PET films, the connection parts and the like are the same as those of the embodiment 3 described above, whereas only the interelectrode distance 59*ab* is smaller than the other interelectrode distances 59*bc*, 59*cd*, 59*de* in the embodiment 4. Though not shown, a planar heating element 51*c* has a shape axially symmetrical to the planar heating element 51*b* with respect to the electrode wire 53*e*, and the interelectrode distance 59*ab* between the electrodes 53*a* and 53*b* is set to be smaller than the other interelectrode distances in both of the two planar heating elements 51*b* and 51*c*. In FIG. 9, the planar heating elements 51*b*, 51*c* are fixed by the support members 63 to the battery 62. Each planar heating element is fixed so that a side thereof that has the smaller interelectrode distance and that includes the electrode 53*a* is in vicinity of the support member 63.

In such a configuration as described above, the same functions and effects as those of the embodiment 3 described above are attained between the electrode wires 53*a* and 53*b*, and amounts of heat generated from sites with which end parts on one side of the planar heating elements 51*b*, 51*c* and the support members 63 coincide and which are prone to radiate heat (that is, sites corresponding to vicinities of end parts of an object to be heated) can be increased by use of the two planar heating elements 51*b*, 51*c* of the invention on condition that a large number of battery modules 61 stacked in the battery 62 cannot be covered with one planar heating element. In opposite end parts of the planar heating elements 51*b*, 51*c*, which end parts do not coincide with the end parts of the object to be heated, it is unnecessary to make the interelectrode length therein smaller.

It goes without saying that it is effective to use three or more planar heating elements and to place the planar heating elements 51*b*, 51*c* of the invention on both ends on an end face on condition that more battery modules 61 are stacked.

The configurations of the embodiments 1 and 2 described above may be adopted into the planar heating elements of the embodiments 3 and 4.

It is to be noted that, by properly combining the arbitrary embodiments of the aforementioned various embodiments, the effects possessed by them can be produced.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

The disclosure of specification, drawings, and claims of Japanese patent application No. 2010-249283 filed on Nov. 8, 2010 and the disclosure of specification, drawings, and claims of Japanese patent application No. 2011-093747 filed on Apr. 20, 2011 are incorporated herein by reference in entirety thereof.

INDUSTRIAL APPLICABILITY

The planar heating elements in accordance with the invention can be used, as heating elements for heating that are superior in installability, because of small thickness and smoothness thereof in electrode parts also, that offer high reliability and great safety and that can be produced at low cost, for floor heating systems, automobile door mirrors and mirrors of washing stands, for removal of dew and frost, on-vehicle battery heaters, and heating of other sites.

The planar heating elements in accordance with the invention can broadly be applied for heating batteries on hybrid vehicles, electric vehicles and the like for cold districts, as a matter of course, and as other heaters, because the planar heating elements can be provided that make it possible to adjust the distribution of heat generation in the planar heating elements only by the adjustment of the interelectrode distances and to attain uniform temperature distribution in an object to be heated, that increase amount of generated heat per unit area of the planar heating elements, and that offer great safety and high reliability without fear of excessive temperature increase.

The invention claimed is:

1. A planar heating element comprising:

a sheet-like electrical insulating substrate, a sheet-like polymer resistor placed on the electrical insulating substrate, at least one pair of electrodes that includes thin metal wires covered with conductive cover layers, that is placed along a sheet-like surface of the polymer resistor, and that supplies electricity to the polymer resistor, and sheet-like insulating cover material that is bonded to the electrical insulating substrate through hot melt so as to cover the electrodes and the polymer resistor, the insulating cover material facing to the electrical insulating substrate, the electrodes and the polymer resistor being placed between the insulating cover material and the electrical insulating substrate, wherein sectional shape of the cover layers in the electrodes is of an ellipse in general with major axis extending in a direction along a sheet-like surface of the electrical insulating substrate, wherein the hot melt is adhered directly to the elliptical outer surface of the cover layers, wherein at least a part of the electrodes is embedded in the polymer resistor.

2. The planar heating element according to claim 1, wherein a sheet-like outer surface of either one of the electrical insulating cover material and the electrical insulating substrate is generally flat in a region where the electrodes are placed.

3. The planar heating element according to claim 1, wherein softening point of the conductive cover layers is a temperature equal to or lower than sum of melting point of the hot melt and 100° C.

4. The planar heating element according to claim 3, wherein sectional area of the cover layer is equal to or larger than double of sectional area of the thin metal wires in a section of each electrode along a longitudinal direction.

5. The planar heating element according to claim 1, wherein at least three or more electrodes in which adjoining electrodes have different polarities and which are disposed generally in parallel to one another are provided as at least the one pair of electrodes, and the electrodes are placed on the sheet-like polymer resistor so that length between at least one pair of electrodes differs from length between the other pairs of electrodes.

6. The planar heating element according to claim 5, wherein length between one pair of electrodes placed in an end part of the planar heating element is smaller than length between another pair of electrodes placed in next place.

7. The planar heating element according to claim 5, wherein length between one pair of electrodes on one side out of pairs of electrodes placed in both end parts of the planar heating element is smaller than length between the other pair of electrodes.

8. The planar heating element according to claim 5, wherein the polymer resistor has PTC property, and wherein second derivatives of resistance value of the polymer resistor with respect to temperature thereof are always positive at least in a region of 0° C. to 80° C.

9. A manufacturing method for a planar heating element, the method comprising:

placing a sheet-like polymer resistor and at least one pair of electrodes that includes thin metal wires covered with conductive cover layers, which have a round sectional shape, that is placed along a sheet-like surface of the polymer resistor, and that supplies electricity to the polymer resistor, with hot melt interposed, between a sheet-like electrical insulating substrate and sheet-like electrical insulating cover material, softening the cover layers and changing sectional shape thereof into an elliptical shape in general with major axis extending in a direction along a sheet-like surface of the electrical insulating substrate by pressurizing with heating, embedding at least a part of the electrodes in the polymer resistor, and adhering the hot melt directly to the elliptical outer surface of the cover layers and bonding the electrical insulating substrate and the electrical insulating cover material with the polymer resistor and the electrodes between by melting the hot melt.

* * * * *